US005413702A

United States Patent [19]

Yan

[11] Patent Number: 5,413,702

[45] Date of Patent: May 9, 1995

[54] HIGH SEVERITY VISBREAKING OF RESIDUAL OIL

[75] Inventor: Tsoung Y. Yan, Philadelphia, Pa.

[73] Assignee: Mobil Oil Corporation, Fairfax, Va.

[21] Appl. No.: 838,996

[22] Filed: Feb. 21, 1992

[51] Int. Cl.[6] ..... C10G 65/12; C10G 69/06

[52] U.S. Cl. ..... 208/97; 208/74; 208/106

[58] Field of Search ..... 208/97, 127, 106, 174

[56] References Cited

U.S. PATENT DOCUMENTS

| | | | |
|---|---|---|---|
| 2,886,514 | 5/1959 | Griffin, Jr. et al. | 208/127 |
| 3,347,781 | 10/1967 | Behrmann et al. | 208/127 |
| 4,075,079 | 2/1978 | Lang | 208/127 |
| 4,220,518 | 9/1980 | Uchida et al. | 208/127 |
| 4,263,128 | 4/1981 | Bartholic | 208/91 |
| 4,309,274 | 1/1982 | Bartholic | 208/80 |
| 4,334,976 | 6/1982 | Yan | 208/8 LE |
| 4,394,250 | 7/1983 | Grossberg | 208/108 |
| 4,427,538 | 1/1984 | Bartholic | 208/127 |
| 4,490,243 | 12/1984 | Miyauchi et al. | 208/127 |
| 4,504,377 | 3/1985 | Shu et al. | 208/75 |
| 4,510,042 | 4/1985 | Billon | 208/97 |
| 4,530,753 | 7/1985 | Shiroto et al. | 208/97 |
| 4,530,754 | 7/1985 | Shiroto et al. | 208/97 |
| 4,544,479 | 10/1985 | Yan | 208/106 |
| 4,569,753 | 2/1986 | Busch et al. | 208/73 |
| 4,569,754 | 2/1986 | Moore | 208/91 |
| 4,615,791 | 10/1986 | Choi et al. | 208/107 |
| 4,668,378 | 5/1987 | Miyauchi et al. | 208/127 |
| 4,675,098 | 6/1987 | Miyauchi et al. | 208/127 |
| 4,715,947 | 12/1987 | Staggs | 208/78 |

*Primary Examiner*—Helane Myers
*Attorney, Agent, or Firm*—Alexander J. McKillop; Dennis P. Santini; Lori F. Cuomo

[57] ABSTRACT

The present invention provides a process which involves visbreaking of residual oil to produce fuel oil or distillate. The visbreaking is conducted at high severity in a liquid phase, fluidized bed reactor with an $H_2$ quench in the settling zone. The visbreaker effluent and $H_2$ are then hydrotreated to stabilize the product by saturating the unstable species, such as olefins, radicals and other fragments from cracking.

16 Claims, 1 Drawing Sheet

HIGH SEVERITY VISBREAKING OF RESIDUAL OIL

BACKGROUND OF THE INVENTION

This invention relates to the upgrading of hydrocarbon residues to obtain valuable products therefrom. More specifically the invention relates to a severe visbreaking process.

It is important to find improved methods of processing petroleum residua because the quantity of high quality petroleum stock is dwindling. More of the higher value petroleum products must be obtained from, the whole crude and in particular from the resid.

Visbreaking is a mild cracking operation used to reduce the viscosity of heavy residue. The heavy residues are sometimes blended with valuable light oil, or cutter stocks, to produce oils of acceptable viscosity. By use of visbreakers, the viscosity of the heavy residue is reduced so as to lower the requirement of the cutter stock.

Sometimes visbreakers are also used to generate more gas oils for catalytic cracking and naphtha for reforming to increase the gasoline yield in the overall refining operation. To achieve these goals, the visbreaker has to be operated at high enough severity to generate sufficient .quantity of lighter products.

The economic and environmental factors relating to upgrading of petroleum residual oils and other heavy hydrocarbon feedstocks have encouraged efforts to provide improved processing technology, as exemplified by the disclosures of various U.S. patents which include U.S. Pat. Nos. 2,160,814; 2,358,573; 2,695,264; 2,733,192; 3,065,165; 3,696,027; 3,730,879; 3,775,303; 3,870,621; 3,876,530; 3,882,049; 3,897,329; 3,905,893; 3,901,792; 3,964,995; 3,985,643; 4,016,067; 4,054,504; 4,379,747; and the like.

U.S. Pat. No. 4,334,976 discloses a process for upgrading residual oil by heating an admixture of heavy hydrocarbon oil and particulate coal under visbreaking conditions. The heat treatment may be conducted in the presence of hydrogen to increase demetallation of the feedstock, to suppress formation of coke and to increase liquefication of the particulate coal phase. In U.S. Pat. No. 4,544,479 the visbreaker may operate with some hydrogen addition but may operate with no hydrogen addition.

U.S. Pat. No. 4,504,377 discloses a two-stage visbreaking process. The second stage visbreaking is conducted under relatively high severity in contact with a fluidized bed of particulate solids.

U.S. Pat. No. 4,615,791 discloses a visbreaking process may be carried out at high severities in the presence of an aromatic hydrogen donor solvent. There is no disclosure of a visbroken product To improve process economics, the visbreaking should be operated at high severities. However, the operable severity is limited by the formation of insolubles or "coke" which leads to furnace coil fouling and product instability.

Accordingly, it is an object of the present invention to provide a process to maximize visbreaking severity in order to reduce the cutter stock requirement. It is a further object of this invention to provide a process to maximize visbreaking severity to increase distillate yield. It is another objective of this invention to produce stable fuel oil for sale and high quality stock for further processing, such as catalytic cracking. Other objects and advantages of the present invention will become apparent from the accompanying description and illustrated data.

SUMMARY OF THE INVENTION

The present invention provides a process which involves visbreaking of residual oil to produce fuel oil or distillate. The visbreaking is conducted at high severity in a liquid phase, fluidized bed reactor with an $H_2$ quench in the settling zone. The visbreaker effluent and $H_2$ are then hydrotreated to stabilize the product by saturating the unstable species, such as olefins, radicals and other fragments from cracking.

The invention therefore includes a process for heavy hydrocarbon oil conversion which comprises (1) thermally treating heavy hydrocarbon oil feedstock in a reaction zone of a liquid phase, fluidized bed reactor filled with carbonaceous solids under severe visbreaking conditions to form an overflow reaction product, wherein the severity is greater than about 200 seconds, as expressed in equivalent reaction time at 800° F.; (2) separating the solids from said overflow reaction product in a settling zone of said fluidized bed reactor; (3) introducing $H_2$ at the top of said settling zone; (4) passing said overflow reaction product and $H_2$ from said settling zone to a hydrotreater to stabilize the overflow reaction product; (5) separating $H_2$ from the stabilized overflow reaction product and recycling said $H_2$ to said settling zone of said fluidized bed reactor; and (6) fractionating said stabilized overflow reaction product.

DETAILED DESCRIPTION OF THE INVENTION

Figure 1:
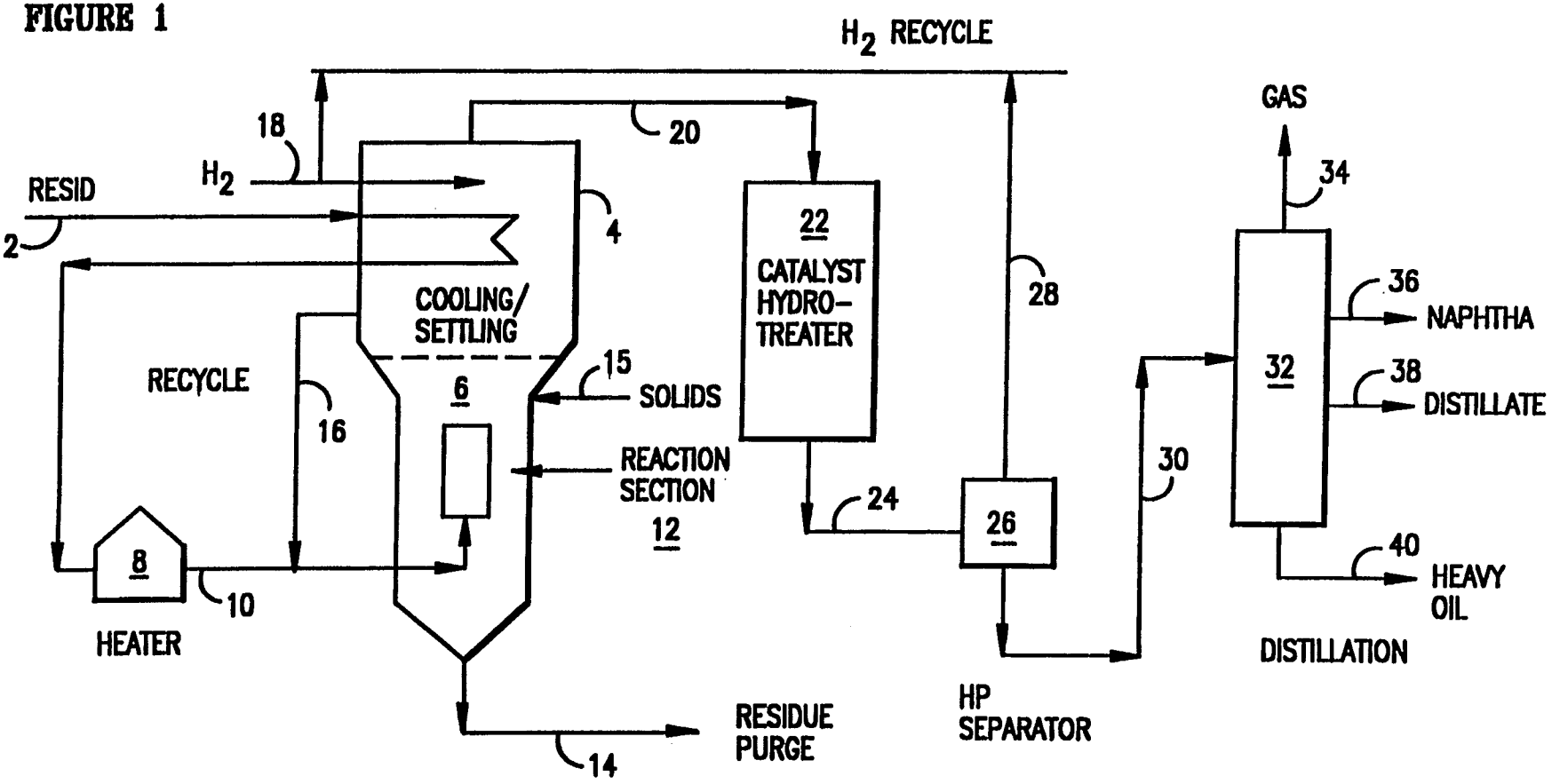
FIG. 1 is a simplified schematic diagram illustrating the process of the present invention.

The invention relates to a process for thermally cracking heavy hydrocarbon resids to produce fuel oil or distillate using a liquid phase, fluidized bed reactor at a high cracking severity.

The term "heavy hydrocarbon oil" is meant to include both atmospheric and vacuum petroleum oil residue, tar sand bitumen feedstocks and liquified coal in which at least 75 wt % of the constituents have a boiling point above about 700° F. (370° C.). Heavy hydrocarbon oil feedstocks useful in the process of the present invention include Arab Heavy resid, Nigerian resid, tar sand bitumen from Alberta, Canada and liquified coal from Illinois No. 6 coal.

The severity of thermal treatment conditions can be expressed in terms of severity (S). Severity is conveniently expressed in terms of "equivalent reaction time in seconds" (ERT), as measured at 800° F. A discussion of the meaning of severity as it is expressed in reaction time in seconds at 800° F. and how it is derived is presented in U.S. Pat. No. 4,504,377 which is incorporated by reference.

Referring to FIG. 1, resids are passed through line 2 and preheated in settling zone 4 of the liquid phase, fluidized bed reactor 6 and then heated in furnace 8 to a temperature in the range of from about 800° to about 1000° F., preferably in the range of from about 850° to about 950° F., and introduced through line 10 to reaction zone 12 of the liquid phase, fluidized bed reactor. The reactor is filled with fluidized carbonaceous solids.

The carbonaceous solids useful for the present invention include coal of all ranks and petroleum cokes, both fluid and delayed. The solid size is generally in the range of from about 100 mesh to 1", preferably in the range of from about 20 mesh to about ¼". Solids with a true density of greater than 0.85, and more particularly greater than 0.9, are preferred.

In the reactor, thermal cracking takes place. In order to improve process economics, the severity should be high, and particularily higher than that of conventional visbreaking. The severity should be at least about 100 seconds higher than for conventional visbreaking. Depending on the resid nature, the severity should be greater than about 200 seconds, as expressed in equivalent reaction time (ERT) at 800° F. and preferably greater than about 500 seconds, as expressed in ERT at 800° F. Illustrative of severity for purposes of the present invention, are greater than about 500 seconds, as expressed in ERT at 800° F. for an Arab Heavy resid feedstock and greater than about 1000 seconds, as expressed in ERT at 800° F. for a Nigerian resid feedstock. For purposes of comparison, the severity for a typical Arab Heavy resid is about 200 as expressed in ERT at 8000° F.

At such severities, copious "coke" will be formed. In a conventional reactor, the coke will plug up the reactor system leading to operational problems. In the reactor filled with fluidized carbonaceous solid, the coke deposits on the fluidized solid surfaces without causing plugging.

The reactor severity in terms of ERT should be controlled to produce "coke" between 0.1 to 10 wt %. Here "coke" is defined as "toluene insolubles." Typically, visbreaking severity is controlled to produce about 0.05 wt % or less coke, in order to form stable product. The amount of toluene insolubles allowed in the present invention is higher than in conventional visbreaking because visbreaking effluent and $H_2$ are passed directly to hydrotreater. The hydrotreatment is believed to cap off the active radicals to form stable hydrocarbon product. Upon standing, the coke, as defined, continues to form in the thermally cracked product if it is not hydrotreated immediately. Hydrotreating loses its effectiveness for product stabilization after the coke is formed on standing.

Because of the coke deposition on the solid, the volume of the fluidized bed increases and should be continuously or intermittently withdrawn in the form of a purge from the bottom of the reaction zone through line 14 to keep the volume constant. The excess carbonaceous solids may be crushed to the desired particle size, preferably in the range of from about 2 to about 20 mesh, and recycled via line 15. Fresh solids are fed intermittently as required into reactor 6 via line 15 to maintain the inventory of solids at a constant level. Because of the fluidized bed, which provides more active surfaces for deposition, the "coke" will not form on the reactor to cause reactor plugging.

Optionally, the liquid volume flow to the reaction zone 12 can be increased by recycling overflow product which is withdrawn through through line 16, in order to keep the fluidized bed in good fluidized condition. When the liquid flow rate is too low, the solid does not stay fluidized and tends to settle, forming a fixed bed and plugging the reactor.

The gas and liquid overflow product from reaction zone 12 is passed to settling zone 4 where the liquid flow velocity is lower and fluidized carbonaceous solid is settled and separated from the liquid. The residence time in the settling zone is generally in the range of from about 500 to about 5000 seconds. The settling zone is kept at a temperature in the range of from about 50° to about 150° F. below the reaction zone.

The heat in settling zone 4 may be used to preheat the heavy hydrocarbon oil feedstock. $H_2$ is introduced at the top of settling zone 4 through line 18. At the top of the settling zone refers to a location near the exit of the reactor and is not critical. Generally, $H_2$ is introduced at a rate in the range of from about 300 to about 2000 SCF/B (standard cubic feet per barrel) and preferably at a rate in the range of from about 500 to about 1000 SCF/B. $H_2$ is directly heated with the overflow product.

The overflow product and $H_2$ from settling zone 4 are passed through line 20 to catalytic hydrotreater 22 to stabilize the product by saturating the unstable species, such as olefins, radicals and other fragments from cracking.

The overflow product and $H_2$ are hydrotreated directly without the need for intermediate storage or additional cooling. Preferably the overflow product and $H_2$ are passed from the reactor to the hydrotreater without exposure to air.

The catalytic hydrotreater 22 is generally operated at a pressure in the range of from about 50 to about 2000 psi and preferably in the range of from about 100 to about 1000 psi. The catalytic hydrotreater is operated at a temperature in the range of from about 100° to about 700° F. and at a liquid hourly space velocity in the range of from about 0.5 to about 10 LHSV[1], depending on the catalyst and pressure.

The hydrogenation catalyst includes Pt, Pd, NiMo, CoMo, NiW, Ni on alumina, silica, silica-alumina and high silica/alumina zeolites, such as ZSM-5 and zeolite Beta. Catalysts with strong hydrogenation activity and resistant to sulfur and nitrogen poisoning are preferred.

The effluent from catalytic hydrotreater 22 is passed through line 24 to a high pressure separator 26 to recover high pressure $H_2$ for recycle through line 28 to settling zone 4. The bottom product from the high pressure separator 26 is withdrawn through line 28 and then fractionated in distillation column 32. As indicated in the drawing the bottom product will typically be fractionated by conventional means into a gas product stream 34, a naphtha product stream 36, a distillate product stream 38 and a heavy oil product stream 40.

The following examples illustrates the process of the present invention.

EXAMPLE 1

A resid feed with the following properties is thermally cracked:

| | |
|---|---|
| CCR (Conradison Carbon Residue), wt % | 19.8 |
| Asphaltenes, wt % | 10.3 |
| Viscosity, c.s. @ 100° C. | 579.6 |

In this example thermal cracking is conducted in an empty reactor, i.e. a reactor not filled with fluidized carbonaceous solids. The reactor is operated at a temperature of 850° F. and at a residence time of 800 seconds, which is equivalent to 2000 seconds, as expressed in ERT at 800° F. Table 1 summarizes the comparative data for each example. The product of each example is observed for a period of 10 days. The product of Example 1 contains 2.7% coke and has a viscosity of 240 c.s. at 100° C. Upon standing, the thermally cracked product is hazy and additional heavy precipitate is formed. The product is unstable.

EXAMPLE 2

This example employs the same resid feed and visbreaking conditions as employed in Example 1. However, 25% of the reactor used in Example 1 is filled with 20×30 mesh crushed coke. The product viscosity is lower than the product viscosity of Example 1, which uses a reactor without carbonaceous solids. Upon standing, the thermally cracked product is clear with coke in suspension. Upon standing for 2 days, precipitate begins to form and after a period of 7 days, heavy black precipitate is formed The product is also unstable.

EXAMPLE 3

This example illustrates the advantages of directly hydrotreating a visbroken product. In this example the clear, but unstable thermally cracked product of Example 2, is directly hydrotreated under the conditions shown in Table 1. The hydrogenation catalyst used is nickel-molybdenum on alumina. The hydrotreated product is stable and is free of heavy carbon precipitate for 10 days.

TABLE 1

| | 1 | 2 | 3 |
|---|---|---|---|
| Visbreaking | | | |
| Temperature, °F. | 850 | 850 | 850 |
| Residence time, seconds | 800 | 800 | 800 |
| ERT @ 800° F. | ~2000 | ~2000 | ~2000 |
| Fluidized bed reactor | No | Yes | Yes |
| Visbroken Product | | | |
| Composition Analysis | | | |
| Asphaltenes, wt. % | 11.2 | 7.8 | 7.8 |
| Resins, wt. % | 9.5 | 10.4 | 10.4 |
| Coke, wt. % | 2.7 | — | — |
| Viscosity, c.s. @ 100° C. | 240 | 160 | 160 |
| Hydrotreating | No | No | Yes |
| Temperature, °F. | — | — | 700 |
| Pressure, psi | — | — | 750 |
| $H_2$ circulation, SCF/B | — | | 1500 |
| Product Quality | unstable* | unstable* | stable |

*Product forms precipitate on standing after two days

Changes and modifications in the specifically described embodiments can be carried out without departing from the scope of the invention which is intended to be limited only by the scope of the appended claims.

I claim:

1. A process for heavy hydrocarbon oil conversion which comprises (1) thermally treating heavy hydrocarbon oil feedstock in a reaction zone of a liquid phase, fluidized bed reactor filled with carbonaceous solids under severe visbreaking conditions to form an overflow reaction product, wherein the severity is greater than about 200 seconds, as expressed in equivalent reaction time at 800° F.; (2) separating the solids from said overflow reaction product in a settling zone of said fluidized bed reactor; (3) introducing $H_2$ at the top of said settling zone; (4) passing said overflow reaction product and $H_2$ from said settling zone to a hydrotreater to stabilize the overflow reaction product; (5) separating $H_2$ from the stabilized overflow reaction product and recycling said $H_2$ to said settling zone of said fluidized bed reactor; and (6) fractionating said stabilized overflow reaction product.

2. The process of claim 1 wherein said heavy hydrocarbon oil feedstock is heated to a temperature in the range of from about 800° to about 1000° F. prior to thermal treatment in said reaction zone.

3. The process of claim 2 wherein said heavy hydrocarbon oil feedstock is preheated in said settling zone of said liquid phase, fluidized bed reactor.

4. The process of claim 1 wherein said carbonaceous solids are continuously withdrawn from the bottom of said reaction zone to maintain the inventory of the carbonaceous solids at a constant level.

5. The process of claim 4 wherein withdrawn carbonaceous solids are crushed to a particle size in the range of from about 2 to about 20 mesh and recycled to said reaction zone.

6. The process of claim 1 wherein said severity is greater than about 500 seconds, as expressed in equivalent reaction time at 800° F.

7. The process of claim 1 wherein said severity is controlled to yield coke deposition in the range of from about 0.1 to about 10 wt %.

8. The process of claim 1 wherein residence time of said heavy hydrocarbon oil feedstock in said reaction zone of said liquid phase, fluidized bed reactor is in the range of from about 50 to about 5000 seconds.

9. The process of claim 1 wherein said $H_2$ is introduced to said settling zone of said liquid phase, fluidized bed reactor at a rate in the range of from about 300 to 2000 SCF/B.

10. The process of claim 1 wherein said settling zone is operated at a temperature in the range of from about 50 to about 150° F. lower than the reaction zone temperature.

11. The process of claim 1 wherein said hydrotreater contains a hydrogenation catalyst.

12. The process of claim 11 wherein said hydrogenation catalyst comprises nickel, molybdenum, cobalt, or any combination thereof.

13. The process of claim 12 wherein said hydrogenation catalyst comprises alumina, clay, silica-alumina, ZSM-5 or zeolite Beta.

14. The process of claim 1 wherein said hydrotreater is operated at a pressure in the range of from about 50 to about 2000 psi, a temperature in the range of from about 100° to about 700° F. and a liquid hourly space velocity in the range of from about 0.5 to about 10 $LHSV^{-1}$.

15. A process for heavy hydrocarbon oil conversion consisting essentially of (1) thermally treating heavy hydrocarbon oil feedstock in a reaction zone of a liquid phase, fluidized bed reactor filled with carbonaceous solids under severe visbreaking conditions to form an overflow reaction product, wherein the severity is greater than about 200 seconds, as expressed in equivalent reaction time at 800° F.; (2) separating the solids from said overflow reaction product in a settling zone of said fluidized bed reactor; (3) introducing $H_2$ at the top of said settling zone; (4) passing said overflow reaction product and $H_2$ from said settling zone to a hydrotreater to stabilize the overflow reaction product; (5) separating $H_2$ from the stabilized overflow reaction product and recycling said $H_2$ to said settling zone of said fluidized bed reactor; and (6) fractionating said stabilized overflow reaction product.

16. A process for heavy hydrocarbon oil conversion which comprises (1) thermally treating heavy hydrocarbon oil feedstock in a reaction zone of a liquid phase, fluidized bed reactor filled with carbonaceous solids for a residence time in the range of from about 50 to about 5000 seconds under severe visbreaking conditions to form an overflow reaction product, wherein the severity is greater than about 200 seconds, as expressed in equivalent reaction time at 800° F.; (2) separating the solids from said overflow reaction product in a settling zone of said fluidized bed reactor; (3) introducing $H_2$ at the top of said settling zone; (4) passing said overflow reaction product and $H_2$ from said settling zone to a hydrotreater to stabilize the overflow reaction product; (5) separating $H_2$ from the stabilized overflow reaction product and recycling said $H_2$ to said settling zone of said fluidized bed reactor; and (6) fractionating said stabilized overflow reaction product.

* * * * *